US010995507B2

(12) United States Patent
Panayiotou

(10) Patent No.: US 10,995,507 B2
(45) Date of Patent: May 4, 2021

(54) SWIMMING POOL COPING AND METHODS OF MANUFACTURING AND USING SAME

(71) Applicant: Eracles Panayiotou, Toms River, NJ (US)

(72) Inventor: Eracles Panayiotou, Toms River, NJ (US)

( * ) Notice: Subject to any disclaimer, the term of this patent is extended or adjusted under 35 U.S.C. 154(b) by 2 days.

(21) Appl. No.: 16/412,255

(22) Filed: May 14, 2019

(65) Prior Publication Data

US 2020/0048921 A1 Feb. 13, 2020

Related U.S. Application Data

(60) Provisional application No. 62/764,573, filed on Aug. 9, 2018.

(51) Int. Cl.
*E04H 4/14* (2006.01)

(52) U.S. Cl.
CPC ..... *E04H 4/141* (2013.01)

(58) Field of Classification Search
CPC ..... E04H 4/141
USPC ..... 4/506; 482/55
See application file for complete search history.

(56) References Cited

U.S. PATENT DOCUMENTS 3,335,429 A * 8/1967 Arp ..... E04H 4/141 52/716.2
3,477,190 A * 11/1969 Wood, Jr. ..... E04H 4/142 52/716.2
3,512,326 A * 5/1970 Greene ..... E04D 3/405 52/716.2
3,777,318 A * 12/1973 Stillman, Jr. ..... E04H 4/142 52/300
3,835,481 A * 9/1974 Engelhart ..... E04H 4/142 52/169.7
3,839,748 A * 10/1974 Stillman, Jr. ..... E04H 4/142 52/300
3,872,195 A * 3/1975 Stegmeier ..... E04H 4/141 264/35
D284,971 S * 8/1986 Deason ..... D15/136
4,901,492 A * 2/1990 Coates ..... E04H 4/10 362/101
5,680,730 A * 10/1997 Epple ..... E04H 4/14 362/145
6,725,469 B2 * 4/2004 Coates ..... E04H 4/141 4/496
7,546,713 B2 * 6/2009 Bradley ..... E04H 4/141 52/102
8,960,636 B1 * 2/2015 Stegmeier, Jr. ..... E04F 13/147 249/19
9,476,215 B2 * 10/2016 Baldoni ..... E04H 4/142
10,006,215 B1 * 6/2018 Deeb ..... E04H 4/142
10,100,544 B2 * 10/2018 Crocker ..... E04H 4/141
10,358,836 B2 * 7/2019 Baldoni ..... E04H 4/142
10,385,580 B2 * 8/2019 Foley ..... E04G 17/14
2003/0009822 A1 * 1/2003 Coates ..... E04H 4/141 4/506

(Continued)

*Primary Examiner* — Lori L Baker

(57) ABSTRACT

In some embodiments, a swimming pool coping having an upper end, a lower end, a front end, and a back end, the coping includes a main body extending from the upper end toward the lower end, a horizontal extension attached to the back end of the main body and being perpendicular thereto, and at least one vertical extension parallel with the main body and spaced away from the main body.

20 Claims, 4 Drawing Sheets

(56) References Cited

U.S. PATENT DOCUMENTS

2004/0123380 A1* 7/2004 Shebek ..... E04H 4/10
4/502
2004/0168385 A1* 9/2004 Marbach ..... E04H 4/0018
52/287.1
2005/0091738 A1* 5/2005 Smith ..... E04H 4/142
4/506
2005/0262780 A1* 12/2005 Bradley ..... E04H 4/141
52/169.7
2008/0001135 A1* 1/2008 Dellinger ..... E04H 4/06
256/31
2009/0014613 A1* 1/2009 Szymczak ..... E04H 4/1272
248/304
2010/0251474 A1* 10/2010 Hempleman-Adams .....
E04H 4/148
4/504
2012/0318435 A1* 12/2012 Castelluci, Sr. .... B29C 48/0022
156/71
2014/0317839 A1* 10/2014 Hempleman-Adams .....
E04H 4/141
4/506
2019/0010720 A1* 1/2019 Baldoni ..... E04H 4/141

* cited by examiner

SWIMMING POOL COPING AND METHODS OF MANUFACTURING AND USING SAME

FIELD OF THE DISCLOSURE

The present disclosure relates to swimming pool construction. More specifically, the present disclosure relates to devices and methods of swimming pool coping.

BACKGROUND OF THE DISCLOSURE

Current swimming pool copings are limited by lacking a variety of aesthetic designs. Additionally, swimming pools, and in particular vinyl swimming pools, often do not have a finished look as they lack color, design and a sleek profile to the swimming pool design. Additionally, decorative materials, such as tile, that are adhered directly to a pool liner have a high failure rate. Adhered material also are not clearly visible which diminishes the aesthetics and the perceived value of the swimming pool.

SUMMARY OF THE DISCLOSURE

In some embodiments, a swimming pool coping having an upper end, a lower end, a front end, and a back end, the coping includes a main body extending from the upper end toward the lower end, a horizontal extension attached to the back end of the main body and being perpendicular thereto, and at least one vertical extension parallel with the main body and spaced away from the main body.

BRIEF DESCRIPTION OF THE DISCLOSURE

Various embodiments of the presently disclosed swimming pool copings are described herein with reference to the drawings, wherein.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to swimming pools, conventional construction methods suffer from some shortcomings as described above.

There therefore is a need for further improvements to the devices, systems, and methods of manufacturing swimming pools. Among other advantages, the present disclosure may address one or more of these needs.

Figure 1:
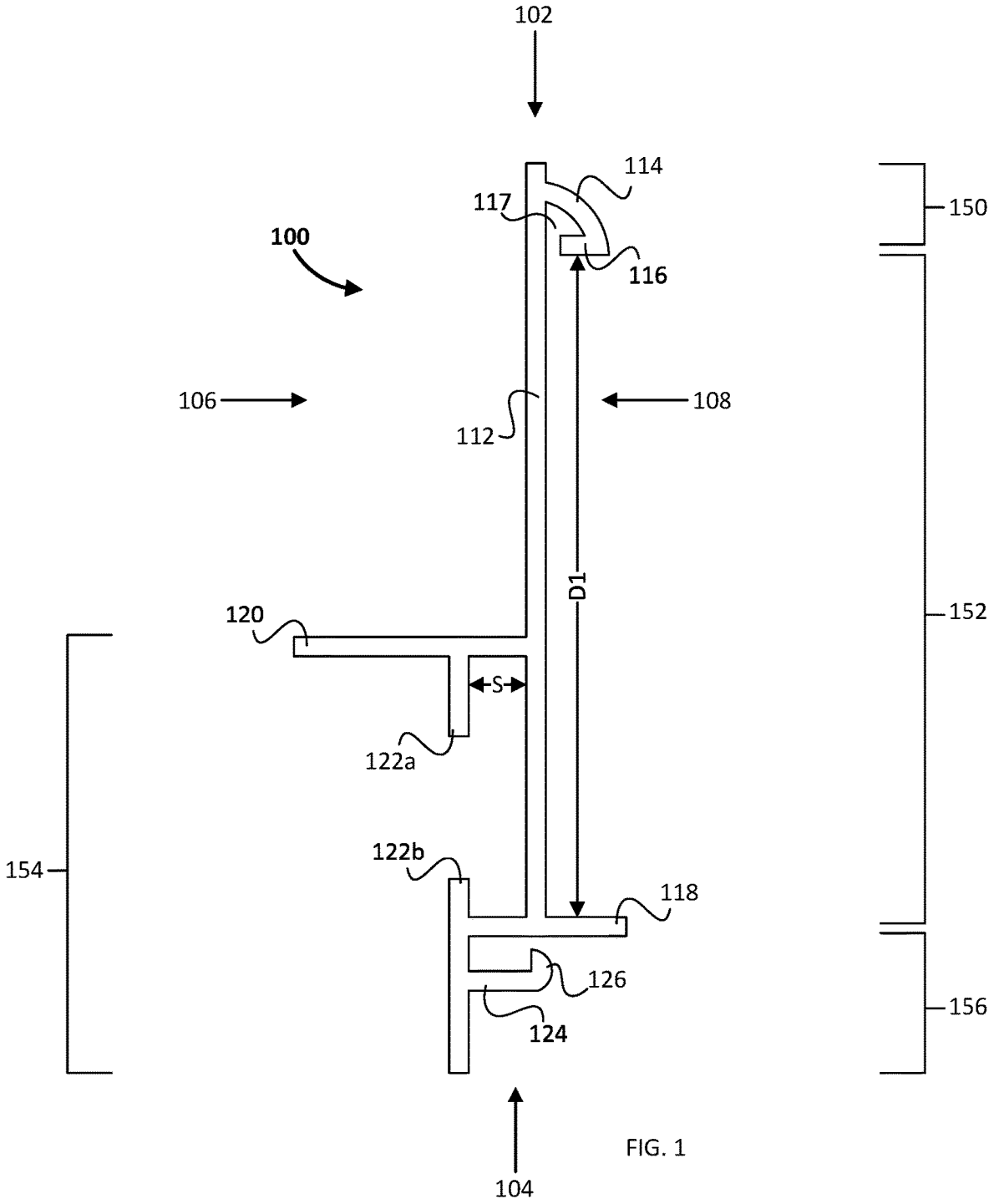
FIG. 1 is a schematic cross-sectional view of a swimming pool coping according to one embodiment of the present disclosure.

FIG. 1 is a schematic cross-sectional view of a swimming pool coping 100 according to the present disclosure. Coping 100 is generally formed of plastic or metal (e.g., aluminum) frame that extends around the perimeter of a swimming pool. It will be understood that other suitable materials for the coping may also be used for the coping, including materials that are suitably rust-proof, resilient and capable of being adhered to a decorative element, such as tile, via adhesive, cement or glue. Coping 100 extends between an upper end 102 and a lower end 104, and includes a back end 106 that faces a pool wall and a front end 108 that faces the water. Coping 100 may generally have four regions including a lighting receptacle 150, a decorative element or tile receiver 152, an attachment region 154 and a liner receiver 156. Each of these regions will be described in additional detail below.

Coping 100 includes a main body 112 that extends vertically between upper end 102 and lower end 104. In at least some examples, main body 112 may have a height of between 1 inches and 15 inches, and a thickness of approximately ½ to 1 inch. As shown, main body 112 may form a spine onto which the various regions are connected.

Closest to upper end 102 is a lighting receptacle region 150. A protruding shoulder 114 may branch from the main body 112. In at least some examples, the protruding shoulder 114 is arcuate as shown, and forms a generally curved portion that is connected to a horizontal upper lip 116, the shoulder, the upper lip and the main body forming a cavity 117 therebetween. In at least some examples, this cavity will be large enough to receive an LED strip or other lighting element that will illuminate the top of the swimming pool. As shown, upper lip 116 is coupled to the shoulder 114 but does not extend all the way to the main body 1112, leaving a gap through which the lighting element may be received or removed.

Upper lip 116 also forms a portion of the tile receiving region 152. Specifically, a horizontal upper lip 116 is formed as described above, and a horizontal lower lip 118 extends from main body 112, the upper and lower lips being substantially parallel with one another. The distance D1 between upper lip 116 and lower lip 118 may be selected as needed. In at least some examples, the distance D1 is between 1 and 12 inches. Additionally, each of upper and lower lips 116,118 may extend a same distance from main body 112, the distance being approximately equal to, or slightly larger than, a thickness of a tile and adhesive.

Turning now to the back end 106 of coping 100, the attachment region 154 will be discussed. Attachment region includes a first horizontal extension 120 that may be parallel with the upper and lower lips 116, 118. In at least some examples, horizontal extension 120 may be approximately 6 to 12 inches in length. A first vertical extension 122*a* may branch out from the horizontal extension 120 and be disposed perpendicular thereto. A second vertical extension 122*b* may be coupled or unitarily formed with a rear extension of lower lip 118 as shown, and be aligned with first vertical extension 122*a*. In some examples, the first and second vertical extensions 122*a*, 122*b* are continuous. In other examples, the two vertical extensions are aligned and in the same plane as shown, but separated from one anther by a gap. Horizontal and vertical extensions 120, 122*a*,122*b* may be configured to sit on an edge of a pool wall as will be described in greater detail below with reference to FIG. 2. The vertical extensions 122*a*, 122*b* may be parallel with main body 112. It will be appreciated that a spacing "S" is defined between the vertical extensions and the main body. This spacing "S" may be selected so that the tiles or other decorative material in tile receiver 152 slightly overhangs the edge of the pool wall. In at least some examples, spacing "S" is between 2 and 6 inches.

Adjacent the lower end 104 of the coping 100, and disposed on the front end 108 is a liner receiver region 156. Liner receiver region 156 generally includes a liner channel 124 that extends from the second vertical extension 122*b* and is perpendicular thereto, and liner mating edge 126 that is configured to mate with a corresponding liner bead and secure the top of the liner. Liners may include beads of various shapes and sizes, and the shape of mating edge 126 may be selected to match a complementary liner bead.

It will be understood that all of the components of coping 100 may be unitarily formed. Alternatively, the various regions may be separately formed and coupleable to main body 112. A coping also need not have all of the regions and certain ones of the regions may be optional. For example, lighting receptable region may be optional. Additionally, certain variations are possible including adjustment in distance D1 between the upper and lower lips or the shape of the liner mating edge 126.

Figure 2:
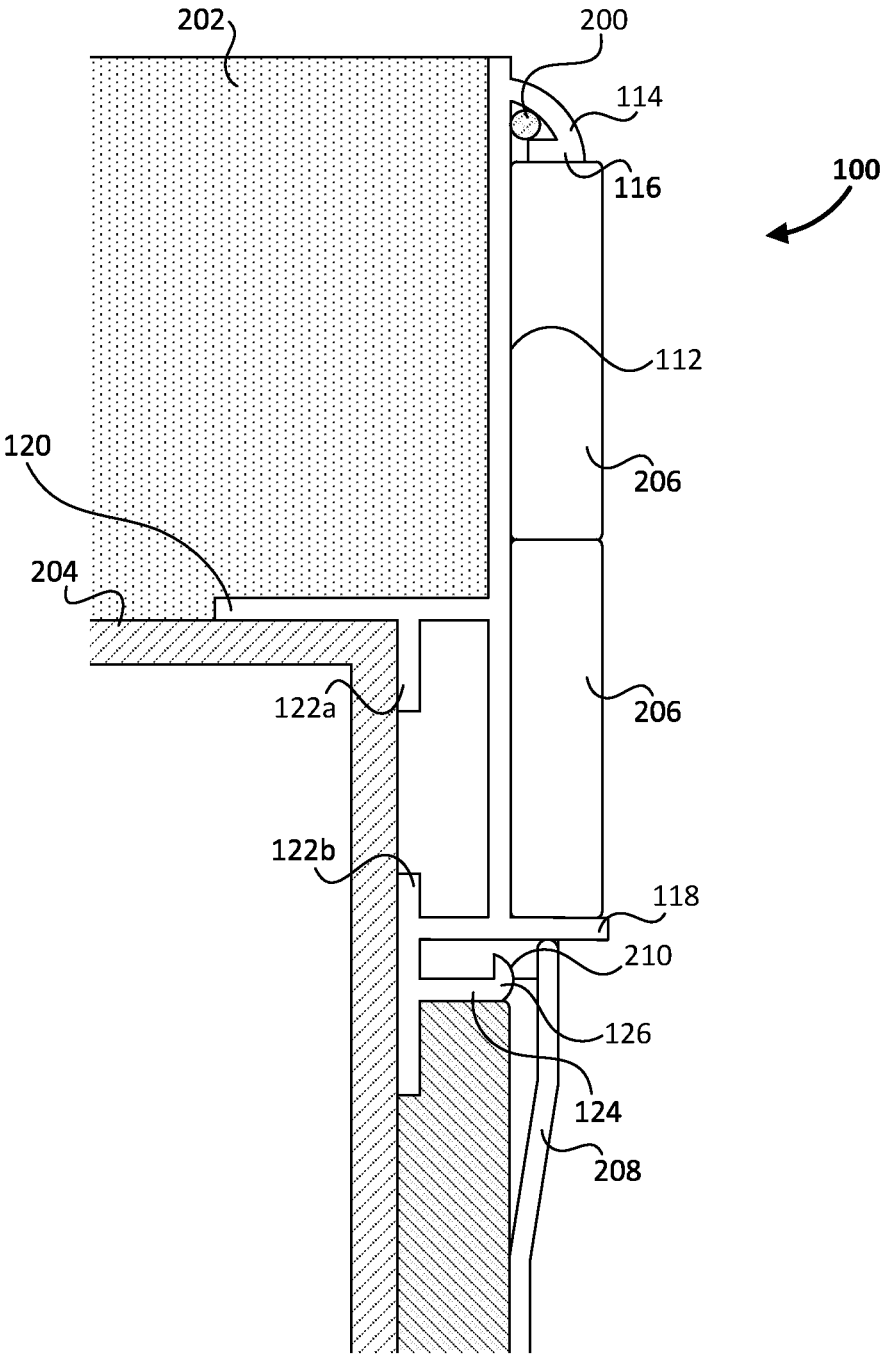
FIG. 2 is a schematic cross-sectional view of the coping of FIG. 1 in use with a swimming pool.

FIG. 2 illustrates the use of a coping 100. As shown, coping 100 sits on the edge of a pool wall 204, the horizontal extension 120 resting on the upper edge of the pool wall 204, and the vertical extensions 122*a*, 122*b* being parallel with and in contact with the side edge of the pool wall 204. With the coping 100 in the proper position, concrete or other material 202 may be poured onto the horizontal extension 120 and into the area defined between the main body 112 and the horizontal extension 120. When concrete 202 sets it will keep coping 100 in position. A LED or other lighting strip 200 may be introduced into cavity 117 of the lighting receptacle 150, and tiles 206 may be adhered to the main body 112 between upper and lower lips 116, 118, the two lips providing support for the tiles. It will be understood that where the phrases "tile" and "tile receiver" have been used, it will be understood that other decorative elements or materials may be disposed therein, including ceramic, glass, wood, stone, and/or other patio materials. Cement, glue, adhesive or any suitable material may be used to couple the tiles or decorative item to main body 112.

Lining 208 (e.g., vinyl lining) may be coupled to liner receiver 156 by mating lining bead 210 with liner mating edge 126 and introducing the bead within the space disposed between the lower lip 118 and liner channel 124. In some examples, a styrofoam or other padding material may be disposed behind the liner 208 and between the liner and the pool wall 204.

Figure 3:
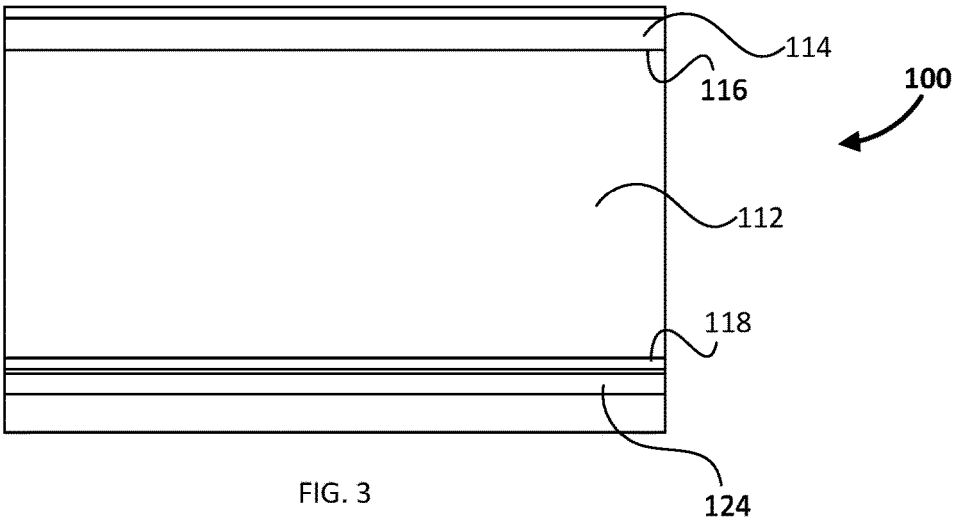
FIG. 3 is a schematic front-view of a section of swimming pool coping.
Figure 4:
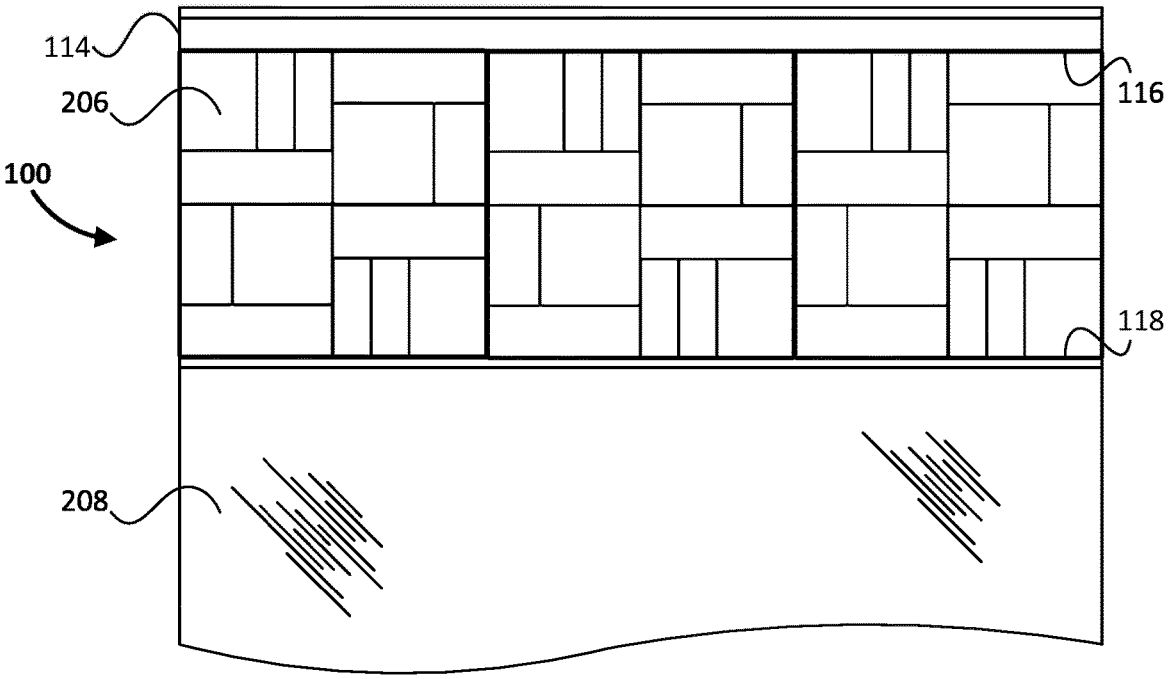
FIG. 4 is a schematic front-view of a section of swimming pool coping after attachment of tiles and a vinyl liner.

FIGS. 3 and 4 provide schematic front views of a coping 100 before and after installation of tiles 206 and attachment to liner 208. The completed assembly has a finished and more appealing look. Thus, coping 100 allows the simple and easy installation of tiles, lighting elements and the liner while being properly secured to the pool wall. Additionally, certain elements may be replaced easily using the coping 100. For examples, tiles may be easily removed from the coping and replaced with another design. Failed lighting elements may also be easily removed and replaced, and the lining itself may be easily replaced while leaving all the other elements in place. Finally, the overhang provided by spacing "S" between the main body and the vertical extensions may slightly project the tiles into the swimming area and give a more refined and beautiful appearance.

Figure 5:
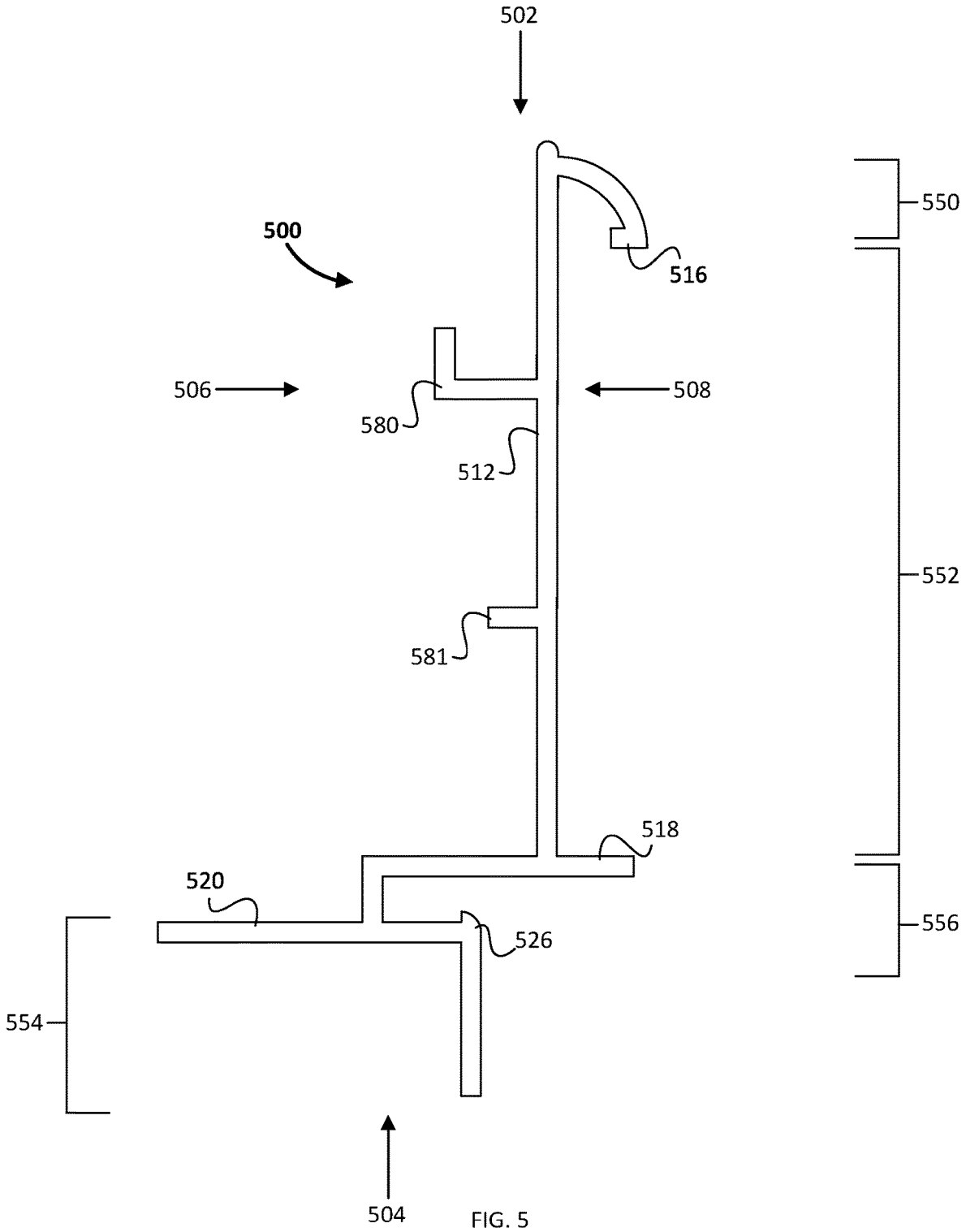
FIG. 5 is a schematic cross-sectional view of a swimming pool coping according to another embodiment of the present disclosure.

FIG. 5 is a schematic cross-sectional view of another example of a swimming pool coping 500 according to the present disclosure. Coping 500 is generally similar to coping 100 and includes the same basic structures. Similar elements in the two embodiments are numbered with similar reference numerals, except that they begin with a "5" instead of a "1". Coping 500 is formed of plastic or metal (e.g., aluminum) frame that extends around the perimeter of a swimming pool and may include all of the configurations, materials, advantages and techniques used in forming coping 100. Coping 500 extends between an upper end 502 and a lower end 504, and includes a back end 506 that faces a pool wall and a front end 508 that faces the water. Coping 500 may generally have four regions including a lighting receptacle 550, a decorative element or tile receiver 552, an attachment region 554 and a liner receiver 556, similar to those described above.

Coping 500 includes a main body 512 that extends vertically between upper end 502 and lower end 504. In at least some examples, main body 512 may have a height of between 3 and 5 inches, and a thickness of approximately 1/12 to 1 inch. As shown, main body 512 may form a spine onto which the various regions are connected.

Closest to upper end 502 is a lighting receptacle region 550 having a protruding shoulder and a lip 516 similar to that above. Added L-shaped member 580 and horizontal bar-shaped member 581 are included to increase rigidity of the coping and improve coupling to the cement or other coupling material. A lower lip 518 is coupled to the main body 512 and forms a step with horizontal extension 520. Additionally, in this example, liner mating edge 526 that is misaligned with main body 512. Specifically, liner mating edge 526 is set back by anywhere between 0.5 inches to 2 inches from the axis of main body 512.

Although the invention herein has been described with reference to particular embodiments, it is be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A swimming pool coping having an upper end, a lower end, a front end, and a back end, the coping comprising:

a main body extending from the upper end toward the lower end;

an upper lip coupled to the main body;

a lower lip couple to the main body and spaced away from the upper lip;

a horizontal extension attached to the back end of the main body and being perpendicular thereto;

at least one vertical extension parallel with the main body and spaced away from the main body;

a liner channel unitarily formed with the main body and disposed adjacent the lower end; and a plurality of tiles adhered to the main body and disposed between the upper lip and the lower lip.

2. The swimming pool coping of claim 1, wherein the lower lip and the upper lip extending from the front end of the main body, away from the horizontal extension.

3. The swimming pool coping of claim 2, further comprising an arcuate shoulder coupled to the main body and forming a cavity between the shoulder and the main body, the cavity being sized to receiving a lighting element.

4. The swimming pool coping of claim 3, wherein the upper lip is coupled to the arcuate shoulder.

5. The swimming pool coping of claim 2, wherein the upper lip and the lower lip are parallel with one another and spaced from one another by at least 6 inches.

6. The swimming pool coping of claim 1, wherein the at least one vertical extension is spaced from the main body by at least 2 inches.

7. The swimming pool coping of claim 2, wherein the at least one vertical extension includes a first vertical extension and a second vertical extension.

8. The swimming pool coping of claim 7, wherein the first vertical extension is coupled to the horizontal extension and the second vertical extension is coupled to the lower lip.

9. The swimming pool coping of claim 7, wherein the liner channel is coupled to the second vertical extension.

10. The swimming pool coping of claim 9, wherein the liner channel includes a liner mating edge configured and arranged to couple to a bead of pool liner.

11. The swimming pool coping of claim 1, wherein the coping is formed of a unitary frame.

12. The swimming pool coping of claim 1, wherein the coping comprises a plastic.

13. The swimming pool coping of claim 1, wherein the coping comprises a metal.

14. A method of forming a swimming pool comprising:

providing a swimming pool coping having an upper end, a lower end, a front end, and a back end, the coping including a main body extending from the upper end toward the lower end, an upper lip coupled to the main body, a lower lip coupled to the main body and spaced away from the upper lip a horizontal extension attached to the back end of the main body and being perpendicular thereto, at least one vertical extension parallel with the main body and spaced away from the main body, a liner channel unitarily formed with the main body and disposed adjacent the lower end; and adhering a plurality of tiles to the main body between the upper lip and the lower lip.

15. The method of claim 14, further comprising the step of placing the coping on an edge of a pool wall so that the horizontal extension is in contact with an upper surface of a pool wall, and at least one vertical extension is in contact with a side edge of the pool wall.

16. The method of claim 15, further comprising the step of placing a material on the horizontal extension.

17. The method of claim 16, wherein placing a material includes pouring concrete.

18. The method of claim 17, further comprising the step of attaching a pool liner to the liner channel.

19. The swimming pool coping of claim 1, wherein the main body is planar between the upper lip and the lower lip, and the upper and lower lips are planar.

20. The swimming pool coping of claim 1, wherein the upper lip forms a portion of a lighting receptacle.

* * * * *